United States Patent [19]

Moriya

[11] Patent Number: 4,893,573

[45] Date of Patent: Jan. 16, 1990

[54] OVERLOCK SEWING MACHINE

[75] Inventor: Akira Moriya, Tendo, Japan

[73] Assignee: Suzuki Manufacturing Co., Ltd., Japan

[21] Appl. No.: 354,833

[22] Filed: May 22, 1989

[30] Foreign Application Priority Data

Oct. 14, 1988 [JP] Japan ..... 63-259205

[51] Int. Cl.[4] ..... D05B 87/02

[52] U.S. Cl. ..... 112/225

[58] Field of Search ..... 112/225, 302

[56] References Cited

U.S. PATENT DOCUMENTS

| | | | |
|---|---|---|---|
| 1,260,611 | 3/1918 | Welling | 112/225 |
| 1,266,741 | 9/1918 | Martinelli | 112/225 |
| 1,803,918 | 5/1931 | Rozdilski | 112/225 |
| 3,308,778 | 3/1967 | Nakajima | 112/225 |
| 3,400,678 | 9/1968 | Bennison | 112/225 |

*Primary Examiner*—Werner H. Schroeder
*Assistant Examiner*—David K. Suto
*Attorney, Agent, or Firm*—Lorusso & Loud

[57] ABSTRACT

The invention discloses an overlock sewing machine equipped with a threading unit of very simple configuration, which comprises a shaft having a threading member fixed thereon and a mechanism (including arm and disc elements) for determining the rotation timing of the shaft.

2 Claims, 5 Drawing Sheets

OVERLOCK SEWING MACHINE

BACKGROUND OF THE INVENTION

1. Field of the Invention

This invention relates to an overlock sewing machine and more particularly, to a threading unit thereof.

2. Related Art Statement

The work of passing a thread through a needle is very difficult even for an operator with normal eyesight; therefore, various types of threading units have been proposed. For example, a first type ( as disclosed in Japanese Utility Model Application Laid-Open No. 53-35061 or No. 61-35188) uses a control member by which a thread setting member, such as a thread setting hook or a threading wire, is passed through the eye of a needle, and after a thread is hitched to the thread setting member or passed therethrough, the thread setting member is retracted. A second type ( as disclosed in Japanese Patent Aplication Laid-Open No. 50-37548 or Japanese Utility Model Application Laid-Open No. 55-37096) utilizes air flow or its suctional action.

However, the foregoing types of threading units generally are not adaptable for the overlock sewing machine equipped with a looper, a cloth cutting knife, etc. because of mechanical complexity; thus, no overlock sewing machine has been proposed to be equipped with any threading unit.

Some prior art types have thread setting mechanisms simplified in configuration, but require delicate control timing and skill.

Further, according to the conventional threading unit, the needle must be positioned at a given position, e.g. a top dead point to pass the thread setting member through the eye of the needle; hence, a needle positioner is provided separately from the threading unit.

However, the needle positioner is expensive and renders the mechanism complicated.

SUMMARY OF THE INVENTION

The above-described drawbacks in the prior art machines have been successfully eliminated by the present invention.

It is an object of the present invention to provide an overlock sewing machine equipped with a threading unit which is simplified in configuration and easy to control.

It is another object of the present invention to provide an overlock sewing machine equipped with a threading unit which includes a positioning mechanism, eliminating the need of an expensive unit such as a needle positioner, and is free from malfunctions.

It is still another object of the present invention to provide an overlock sewing machine equipped with a shaft for threading which is disposed in a space between other power transmission mechanisms or the like crosswisely to the feed direction of a cloth and is easy to manufacture and assemble without any significant modification of the sewing machine now present.

To achieve the foregoing objects, an overlock sewing machine according to the present invention of the type including a needle vertically moving while passing through a needle plate, a knife for cutting a marginal portion of a cloth at a side of the needle plate, and a looper for hemstitching the marginal portion thus cut of the cloth in cooperation with the needle, is equipped with a threading unit comprising a shaft disposed crosswisely to the feed direction of the cloth, a threading member fixed on the shaft and swingable in the rear of the knife, a thread setting hook fixed on the threading member and retractably passable through the eye of the needle, and a knob for rotating the shaft. The threading unit may further include a first positioning member rotatable integrally with the shaft. When the needle is at its given position above the needle plate, the first positioning member engages a second positioning member interlocked with the needle to rotate to thereby pass the thread setting hook through the eye of the needle.

When the knob is controlled to rotate the shaft, the threading member fixed on the shaft swings from the rear of the needle toward the needle; as a result, the thread setting hook fixed on the threading member passes through the eye of the needle. When the shaft is rotated reversely after hitching a thread to the thread setting hook thus passed the eye, the threading member retracts to rearward of the shaft, and at the same time, the thread setting hook comes out of the eye of the needle, whereby the thread hitched on the thread setting hook is passed through the eye of the needle.

Where the threading member is equipped with the positioning member, when the shaft is rotated by controlling the knob, the first positioning member rotatable integrally with the shaft is also rotated. However, when the needle is not at its given position, the second positioning member interlocked with the needle is at a position not engageable with the first positioning member, so that the first positioning member is locked. Accordingly, the thread setting hook is prevented from rotating and can never contact the needle standing at a position other than the given position. Where the needle is at its given position, the first positioning member rotates upon control of the knob to engage the second positioning member standing at its given position and performs a further rotation, so that the thread setting hook can move toward the needle without being prevented to pass through the eye of the needle.

These and other objects of the present invention will become apparent from the following description of embodiments thereof when taken together with the drawings.

DETAILED DESCRIPTION OF THE PREFERRED EMBODIMENTS

The overlock sewing machine of the present invention will now be described with reference to embodiments thereof.

Figure 1:
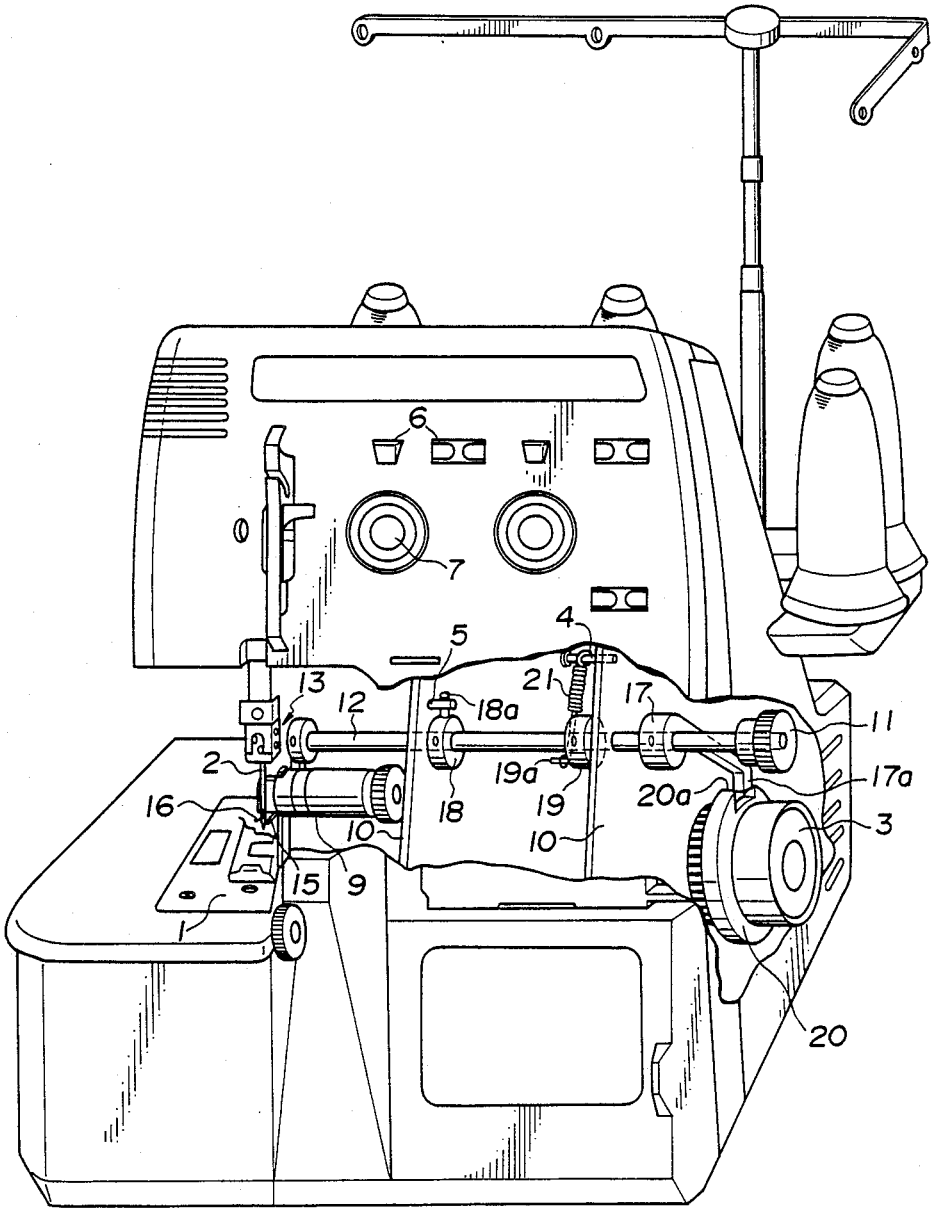
FIG. 1 is a general view of an overlock sewing machine to which the present invention is applied.
Figure 2:
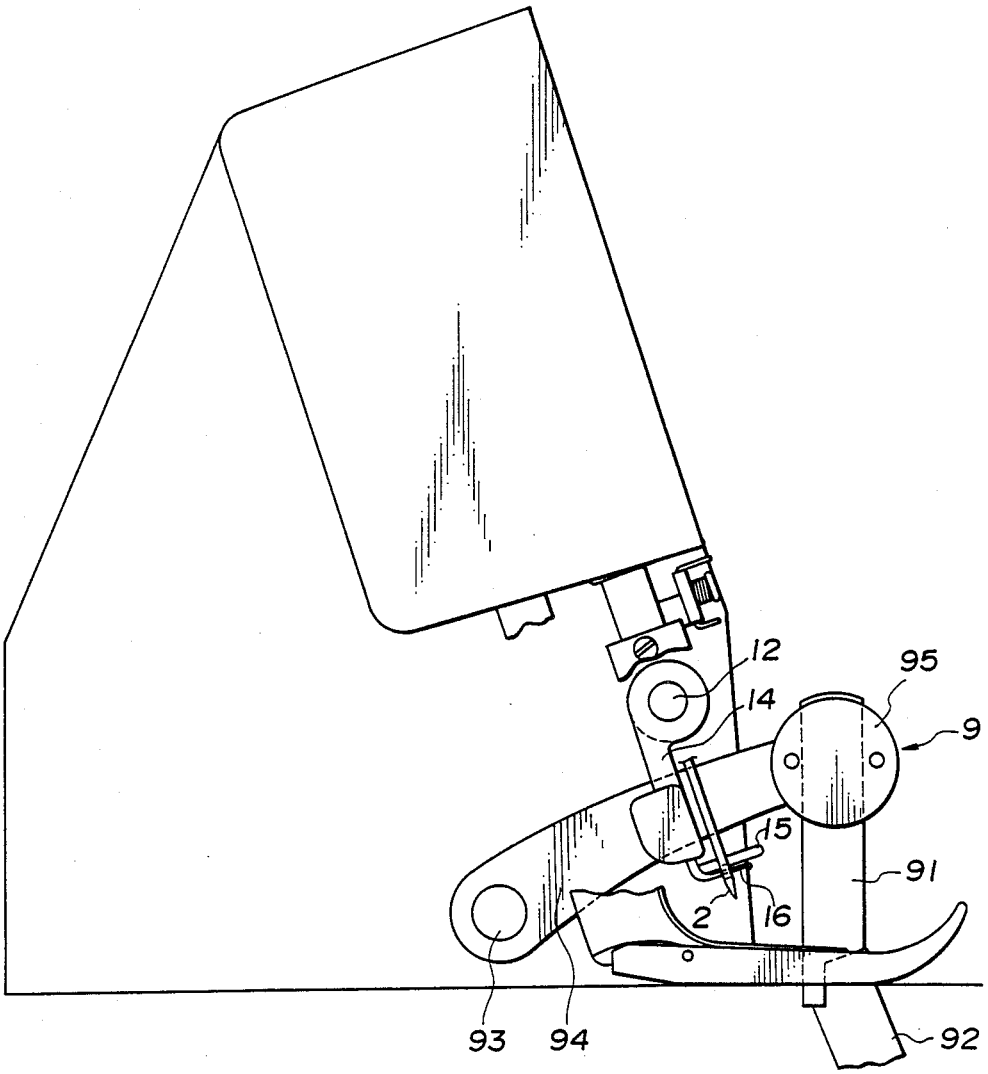
FIGS. 2(*a*) and (*b*) are side views of an important portion of a threading unit according to the present invention.
Figure 2B:
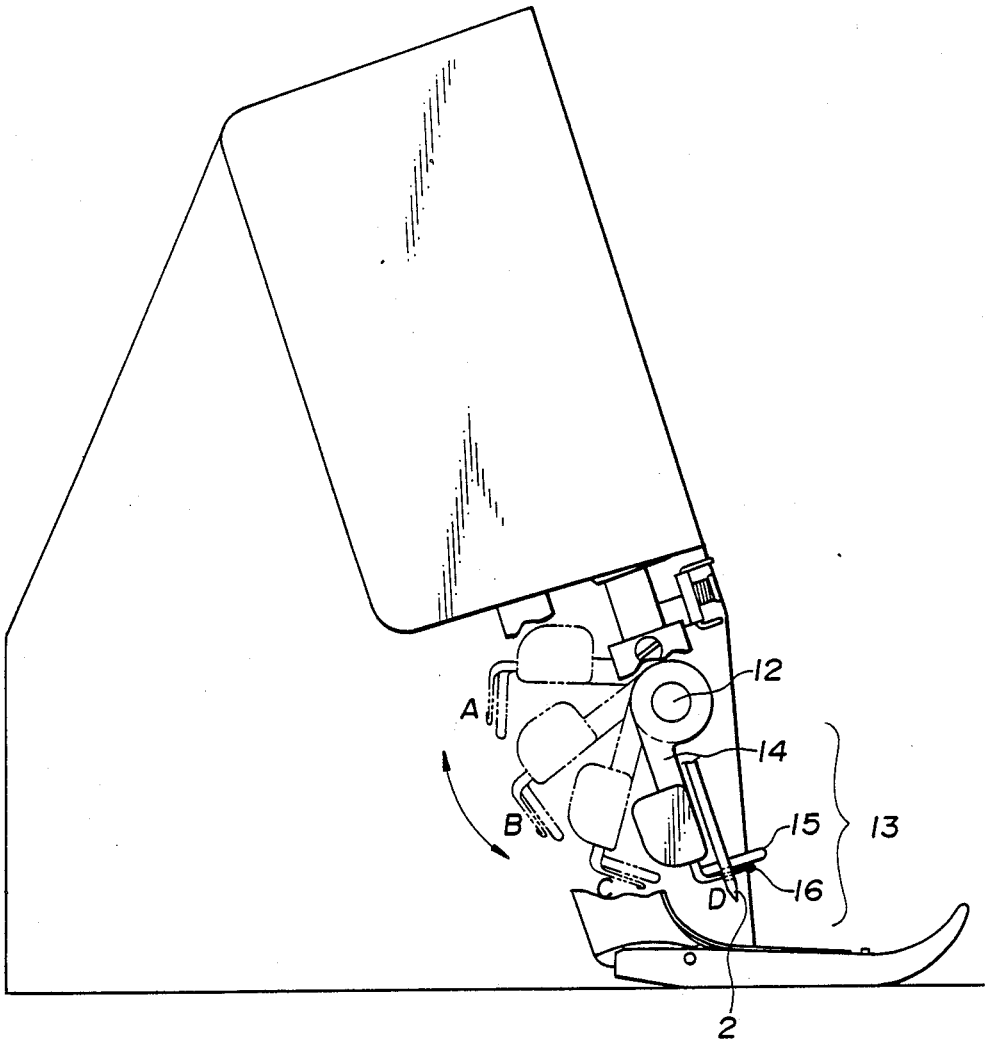

FIG. 1 shows an overlock sewing machine in its entirety to which the present invention is applied, that performs so-called overlock sewing, or the hemstitching of a marginal portion of a cloth using a needle 2 which vertically moves while passing through a needle plate 1 and a looper which performs substantially-circular reciprocating motion both in response to the rotation of a main shaft (not shown), and that is equipped at a side of the needle plate 1 with a knife 9 (FIG. 2(*a*)) for cutting a marginal portion of the cloth. That is, as shown in FIG. 2(*a*), the knife 9 comprises an upper knife piece 91 and a lower knife piece 92, the upper knife piece 91 being attached via a holder 95 to an arm 94 fixed on an upper knife piece drive shaft 93 and crossing with the lower knife piece 92 at a side edge of the needle plate 1 to perform the cloth cutting action. The structure of the needle 2 and of the looper is known in the art; thus, no further description will be given here.

In the thus configured overlock sewing machine, a threading unit comprises a knob 11, a shaft 12 which is rotated by means of the knob 11, a threading member 13 fixed on the shaft 12, and a first positioning member 17 for determining the rotation timing of the shaft 12, the threading member 13 being disposed in a space between the knife 9 and a needle bar. The threading member 13 comprises a threading arm 14 fixed on the shaft 12, a thread guide 15 and a thread setting hook 16 provided side-by-side on the distal end of the threading arm 14 as shown in FIGS. 2(*b*) and 3, which is swingable in the rear of the knife 9.

The shaft 12 is rotatably supported via bearings by a body frame 10 crosswisely to the feed direction of the cloth, whose one end has the control knob 11 fixed thereto. The knob 11 is disposed on the outside of the frame 10, which is adapted to rotate the shaft 12 manually. When the knob 11 is rotated, the threading member 13 fixed on the other end of the shaft 12 is rotated so that the thread setting hook 16 can pass through the eye of the needle 2.

Fixed on the shaft 12 are a timing arm 17 serving as a first positioning member for determining the timing at which the shaft 12 is to be rotated, a stop ring 18 for restricting the rotation of the shaft 12, and a return ring 19 for returning the rotation of the shaft 12. The timing arm 17 determines, in cooperation with a timing disc 20 ( hereinafter referred to as a disc ) serving as a second positioning member hereinafter described, the timing at which the threading action is to be performed with the needle 2 standing at its given position. In the embodiment, the disc 20 is fixed on the main shaft integrally rotatably therewith in contact with a pulley 3 rotatable integrally with the main shaft, which has a notch 20*a* adapted to engage the distal end 17*a* of the timing arm 17. Therefore, the movement of the disc 20 is interlocked with the movement of the needle 2, so that when the main shaft is at its given position, i.e. when the needle 2 is at its given position above the needle plate, e.g. at its top dead point, the notch 20*a* takes a position where it can engage the distal end 17*a* of the timing arm 17. With this position, if the shaft 12 is rotated by means of the knob 11, the timing arm 17 can rotate further to an extent corresponding to the depth of the notch 20*a*. Upon this rotation, the thread setting hook 16 can pass through the eye of the needle 2.

At other timings than the above, even if the timing arm 17 is rotated, the distal end 17*a* contacts the circumference of the disc 20 except for the portion of the notch, so that it can rotate no more. That is, the thread setting hook 16 is locked at a position close to the needle 2, so that it can never collide with the needle 2 moving below the top dead point.

Stretched between a pin 4 attached to the body frame 10 and another pin 19a attached to the return ring 19 is a return spring 21 which is adapted to reverse the shaft 12 rotated by means of the knob 11.

The reverse rotation is stopped if a pin 18*a* attached to the stop ring 18 abuts on a stopper 5 attached to the body frame 10. This mechanism determines the retracted position of the threading member 13.

FIG. 2(*b*) is a side view of the threading member 13, showing its timing of operation, in which A designates the most-retracted position of the threading member 13, i.e. the position where the pin 18*a* of the stop ring 18 abuts on the stopper 5. When the knob 11 is turned to rotate the shaft 12, the threading member 13 rotates along a route of A→B→C. Where the needle 2 is not at its top dead point, the distal end 17*a* of the timing arm 17 abuts on the circumference of the disc 20, so that the threading member stops at position C. On the other hand, where the needle 2 is at its top dead point, the distal end 17*a* of the timing arm 17 engages the notch 20*a* of the disc 20, thus, the shaft 12 can rotate further; as a result, the threading member 13 rotates along an additional route of C→D, so that the thread setting hook 16 passes through the eye of the needle 2. When the knob 11 is released, the shaft 12 is reversed by virtue of the return spring 21, and the threading member 13 returns to the most-retracted position A where the pin 18a abuts on the stopper 5.

The threading operation will now be described.

Figure 3:
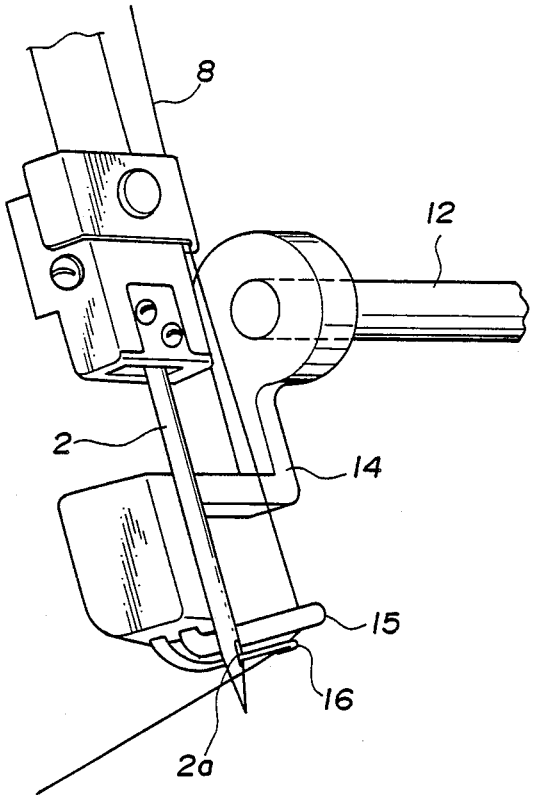
FIG. 3 is a perspective view of the important portion.
Figure 4:
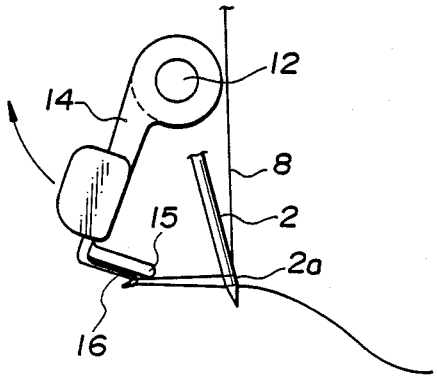
FIG. 4 is a view showing the operation after threading.

Turn the knob 11 with one hand when the needle 2 is at its top dead point; as a result, the distal end 17*a* of the timing arm 17 engages the notch 20*a* of the disc 20 to rotate, so that the thread setting hook 16 passes through the eye 2a of the needle 2. Then, pull with the other hand a thread 8 already taken out along a thread guide 6, a thread tension disc 7, a thread take-up lever, etc. such that the thread is caught on the thread guide 15 as shown in FIG. 3, and release the knob 11. In this step, the thread 8 is required to be caught only on the thread guide 15, not on the thread setting hook 16, thus, the control is very easy. Upon releasing the knob 11, the shaft 12 reverses, so that the thread setting hook 16 comes out of the needle eye 2*a* while keeping the thread 8 caught on its hooked distal end, retracts, and stops at the most-retracted position (position A in FIG. 2(*b*)). Then, pull the thread 8 whose looped portion is passed through the needle eye 2*a*, and pull out the free end of the thread, whereby the threading operation is completed (FIG. 4).

As described above, the work of threading can be performed through a very simple operation using the right hand and left hand, which comprises the steps of (1) turning the knob and (2) hitching the thread. In this regard, when the needle 2 is not at its given position nor at its top dead point in the embodiment, the threading member 13 cannot rotate so as to pass through the needle eye 2a; thus, there is no fear of damage to the needle and to the thread setting hook even under erroneous control.

Further, since the threading member 13 is normally at a remotely-retracted position by virtue of the return spring 21, it does not act as a hindrance at the time of sewing or the like.

Figure 5:
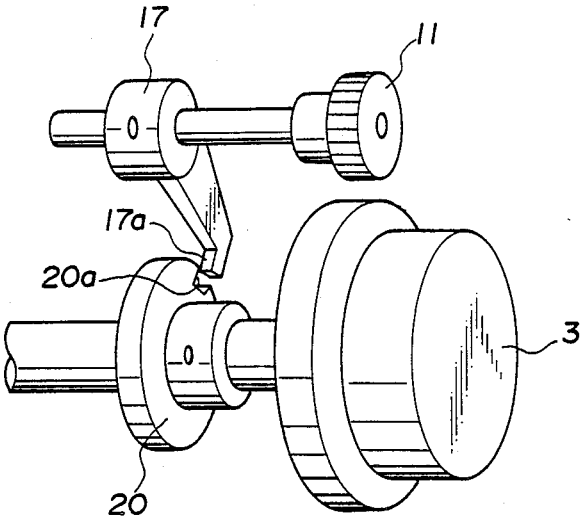
FIGS. 5 and 6 are views showing other embodiments of the threading unit according to the present invention.
Figure 6:
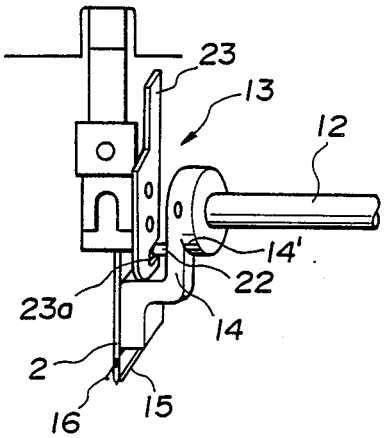

FIGS. 5 and 6 show other embodiments of the threading unit according to the present invention. In the embodiment of FIG. 5, the disc 20 serving as the second positioning member is separated from the pulley 3 and disposed inside the body. In the embodiment of FIG. 6, the first positioning member is made of a pin 22 fixed to the threading arm 14 of the threading member 13, which rotates together with the threading arm 14 in response to the rotation of the shaft 12. On the other hand, a second positioning member 23 is fixed to the lower end of the needle bar for attaching the needle 2 and has a notch 23*a* formed at a side edge thereof which is adapted to engage the pin 22. The second positioning member 23 vertically moves together with the needle 2. When the needle 2 is at its given position, the notch 23*a* engages the pin 22 which is rotated by controlling the knob, so that the pin 22 and the threading arm 14 are permitted to rotate further. That is, the thread setting hook 16 passes through the eye of the needle 2. When the needle 22 is not at its given position, the pin 22 abuts on the side edge of the second positioning member 23, so that the threading member 13 can rotate no more.

It should be noted that the first and second positioning members can be modified freely within the limitations delineated in the appended claims. Further, the the mechanism of stopping and returning the shaft 12 should not be limited to the embodiments and may be modified freely. For example, a stop pin, a return pin and the like may be attached to the shaft 12 and/or the arm elements.

Thus, there is provided in accordance with the present invention the overlock sewing machine which has the advantage discussed above. The embodiments described are intended to be merely exemplary and those skilled in the art will be able to make variations and modifications in them without departing from the spirit and scope of the inventions. All such modifications and variations are contemplated as falling within the scope of the claims.

What is claimed is:

1. An overlock sewing machine comprising a needle vertically moving while passing through a needle plate, a knife for cutting a marginal portion of a cloth at a side of said needle plate, and a looper for hemstitching the marginal portion thus cut of the cloth in cooperation with said needle, and a threading unit comprising a shaft disposed crosswisely to the feed direction of the cloth, a threading member fixed on said shaft and swingable in the rear of said knife, a thread setting hook fixed on said threading member and retractably passable through the eye of said needle, and a knob for rotating said shaft.

2. An overlock sewing machine according to claim 1, wherein said threading unit further includes a first positioning member rotatable integrally with said shaft, and said first positioning member is adapted, when said needle is at a given position above said needle plate, to engage a second positioning member in timed relation with the position of said needle to enable to pass in timed relation with the position of said needle to enable said thread setting hook to pass through the eye of said needle.

* * * * *

UNITED STATES PATENT AND TRADEMARK OFFICE

CERTIFICATE OF CORRECTION

PATENT NO. : 4,893,573

DATED : January 16, 1990

INVENTOR(S) : MORIYA et al

It is certified that error appears in the above-identified patent and that said Letters Patent is hereby corrected as shown below:

IN THE CLAIMS:

Col. 6, line 24, delete "to pass in"; and line 25, delete entire line.

Signed and Sealed this

Nineteenth Day of February, 1991

*Attest:*

HARRY F. MANBECK, JR.

*Attesting Officer*

*Commissioner of Patents and Trademarks*